United States Patent [19]

Chudy et al.

[11] Patent Number: 4,477,309

[45] Date of Patent: Oct. 16, 1984

[54] CORRECTION OF GRAVURE PRINTING MEMBERS

[75] Inventors: Elzbeita Chudy; Nicolette Gamson; Phillip R. Kellner, all of London, England

[73] Assignee: Crosfield Electronics Limited, London, England

[21] Appl. No.: 430,177

[22] Filed: Sep. 30, 1982

Related U.S. Application Data

[63] Continuation of Ser. No. 210,660, Nov. 26, 1980, abandoned.

[30] Foreign Application Priority Data

Dec. 11, 1979 [GB] United Kingdom ..... 7942707

[51] Int. Cl.[3] ..... B41C 1/00; B44C 1/22

[52] U.S. Cl. ..... 156/635; 156/644; 156/654; 156/656; 156/905

[58] Field of Search ..... 156/635, 654, 656, 905, 156/644, 664

[56] References Cited

U.S. PATENT DOCUMENTS 276,893 5/1883 Schulze-Berge ..... 156/635

FOREIGN PATENT DOCUMENTS 1141513 1/1969 United Kingdom ..... 156/635

OTHER PUBLICATIONS

McBride, IBM Technical Disclosure Bulletin, vol. 19, #3, Aug. 1976.

*Primary Examiner*—Bruce H. Hess
*Attorney, Agent, or Firm*—Sughrue, Mion, Zinn, Macpeak and Seas

[57] ABSTRACT

The positive correction of a gravure printing surface is conducted by depositing into the cells of the surface a heat activatable composition that is inert at the temperature of deposition but which, upon heating the surface, causes etching of the cells. When the desired correction has been achieved the etching is terminated, for instance by washing. The compositions are preferably in the form of pastes and include novel compositions comprising alkali metal bisulphate.

11 Claims, No Drawings

CORRECTION OF GRAVURE PRINTING MEMBERS

This is a division of application Ser. No. 210,660, filed November 26, 1980 now abandoned.

This invention relates to the positive correction of gravure printing surfaces, and to compositions for use in this.

A gravure printing surface consists of a large number of cells defined by cell walls. The cells may be discrete cells or they may be grooves. For instance the cells on a gravure roller may be helical grooves. Various methods for making the cells are well known and include various mechanical engraving methods and striking the surface with a laser, ion or electron beam.

The depth of the cells controls the density of printing and it often happens that, after the cells have been formed, it is necessary to deepen the cells in some areas. This deepening is called positive correction and is conducted either to correct an error in the initial cell depth or because of a change in the desired cell depth. Positive correction is generally brought about by etching the base of the cell, using an apropriate acid. It is necessary to prevent the acid etching both cells that do not have to be corrected and also the raised cell walls between cells that do have to be corrected.

Accordingly a typical gravure positive correction process comprises smothering those parts of the printing surface that are not to be corrected by an inert protective material, such as bitumen, applying a protective ink that is resistant to the etchant over the tops, and sometimes parts of the sides, of the cell walls, swabbing the printing surface with the chosen etchant and maintaining contact for the time necessary to give the desired etching, washing the etchant from the surface and then washing the protective ink and the protective coating from the surface using appropriate solvents. The protective ink has to be formulated and applied carefully so that it protects the tops of the cell walls adequately but does not interfere with the chosen etching of the bottoms of the cells.

Often it is necessary for the correction to be a feathering correction, that is to say there should be a gradation of the depth of etching during the correction process across a unit area. At present, this is best done by repeating the process several times but varying the area covered with the protective coating each time, thereby controlling the exposure of the cells to the etchant.

With traditional metal gravure printing surfaces such as of copper, the process is satisfactory but inconvenient. The etchant is generally aqueous ferric chloride for such surfaces. With plastics cylinders, such as based on polyacetal, the process is less satisfactory and more inconvenient. Control of depth of etching on copper and other metal surfaces using ferric chloride can adequately be obtained by altering the duration of contact but on plastics surfaces this is not very satisfactory and control of depth is best achieved by altering concentration of etchant. However there is always a tendency for the etchant either to etch too slowly or to etch uncontrollably fast and so the process has to be operated carefully to obtain the desired results. Accordingly it is rather difficult to obtain appropriate feathering. A typical etchant for polyacetal printing surfaces consists of 40 parts sulphuric acid in 50 parts water and 10 parts phosphoric acid. It can be rather difficult to formulate protective inks and protective coatings that will give the desired protection to the tops of the cell walls and to other areas whilst being inert to this mixture and being capable of being washed off with solvents after the correction has been completed.

A positive correction process according to the invention for a gravure printing surface comprises depositing into the cells to be deepened a heat activatable etching composition that is substantially inert to the cells at the temperature of deposition, heating the composition to a temperature at which it etches the cells, and terminating the etching.

The composition can be prepared and deposited as a powder but is preferably prepared initially as a dispersion in liquid (usually water) of particulate solid (usually including solid etchant), e.g. as a paste, into only those cells that are to be etched. Because the composition can be accurately deposited in those cells only that are to be corrected and because, at the temperature of deposition, it is inert to the material of which the cells are formed it is not essential to protect either the tops of the walls or the adjacent cells that are not being corrected. For instance if composition is erroneously applied in cells that are not to be corrected it can easily be removed from them before correction occurs. A particular advantage of the process therefore is that the adjacent cells that are not to be corrected can be left unprotected during the process, and thus the traditional application of protection covering can be eliminated. Also the traditional application of protective ink can be eliminated, although sometimes it is desirable to apply this.

Deposition is preferably by doctoring a viscous liquid, e.g. a paste, by for instance, a knife solely into those cells that are to be corrected. Excess composition on the tops of the cell walls should be avoided especially when as is preferred, the tops have been left unprotected.

The deposited composition is then heated to a temperature at which etching starts and is maintained at an appropriate etching temperature until the desired amount of each occurred, whereupon etching is terminated, by washing the composition from the surface and/or by cooling the surface.

Heating of the surface can be by any convenient means, for instance by blown hot air. Feathering can be achieved by applying the composition in all areas to be corrected and then heating the printing surface for different times in different areas so as to obtain the locally different depths of etching that are required in the feathered correction. For instance the heating may be initiated locally at different times but terminated in all areas simultaneously.

The composition that is used must be one that has no serious etching properties on the gravure surface at the temperature of application (generally ambient for instance 10 to 30° C.) but which will etch when heated to some convenient higher temperature (generally 50 to 95° C., preferably 60 to 90° C.). This change in properties may be due to a chemical or a physical effect or to a mixture of both. The composition may contain a material either that is present throughout but is sufficiently active only at the higher temperature or that decomposes on heating to form a chemically active compound. The composition may contain a material that becomes available for etching only at the increased temperature. For instance, etching may be due to a material that is encapsulated by a coating material that is ruptured upon heating to release the active material. Preferably etching is started as a result of the concentration of dissolved etchant increasing, as a result of heating, from a value at which the solution is inert to a value at which the solution etches the surface, the etchant thus being insoluble or insufficiently soluble except at the higher temperature.

The nature of the active material will depend partly upon the gravure surface but we have found that acidic salts, preferably dry acid salts, are suitable. Preferably they are based on bisulphates, preferably of alkali metal, and sodium bisulphate is particularly suitable. The active material preferably includes inorganic fluoride, generally an alkali metal fluoride especially sodium fluoride. Preferred active materials comprise mixtures of bisulphate and fluoride, with the mixtures preferably comprising one part sodium fluoride or other alkali metal fluoride and from 5 to 20, preferably 8 to 15, parts sodium or other alkali metal bisulphate, the parts being measured by weight. The active material may include other components to accelerate the rate of etching once the temperature at which etching starts has been exceeded, but of course these other components must not be materials that result in significant etching occurring at ambient temperatures. Suitable other materials that may be included in the active material include dichromates, for instance sodium or, especially, potassium dichromate. Generally the dichromate accounts for less than half the weight of active materials. When the active materials consist predominantly of sodium or other alkali metal bisulphate the amount of dichromate, per part by weight sodium bisulphate, is preferably from 1 to 0.1 parts, generally 0.6 to 0.15 parts. It may be necessary to ensure that some or all of the active materials are stored dry, and possibly separate from other components of the mix. For instance it is generally preferred to store dichromate dry and to mix it with the other active materials only immediately prior to use.

The composition may include inert material that does not react with the gravure surface and which is preferably an inert particulate solid, for instance silica, alumina or pumice.

This inert particulate material serves as an extender and by increasing the concentration of it the rate and depth of etching can be correspondingly reduced.

The composition may include one or more indicators, either to indicate the pH or, more usually, the temperature of the composition. For instance, if the indicator changes colour at the temperature at which etching starts the duration of etching can be measured and thus the depth controlled, by timing from the colour change.

Powdered compositions may consist solely of the active material or materials, optionally with indicator and optionally with inert powder. Paste compositions, which are preferred, additionally contain sufficient liquid carrier to give the desired viscosity (generally a thick paste) and optionally a surfactant, generally an anionic surfactant. The liquid carrier may include organic liquids but preferably is water, optionally with a viscosity adjusting material.

Preferred paste compositions for use in the invention comprise, per part by weight water, 2 to 15, generally 2 to 5, parts active material, and 0 to 3 generally 0.5 to 2 parts inert particulate material together with minor amounts of indicator and surfactant. Broadly, the ratios by weight of the ingredients may be active material:water from 1:1 to 15:1, and preferably 2–5:1, active material:inert solid from 1:3 to no inert solid and preferably 2–5:1, and water:(inert solid + active material) from 20:1 to 1:10 and preferably 1:3–8. The invention includes also novel compositions for use in the process, such compositions being any of those described above.

The process of the invention is applicable to the positive correction of gravure cells in a wide range of gravure printing surfaces. The surfaces may be, for instance, formed of a continuous sheet of copper or of a continuous sheet of a plastics material, such as polyacetal or epoxy (for instance as described in British patent application No. 7931053) or may be formed of two materials, one material defining the cell walls and being, for instance, metal, and the other material filling the cells and being, for instance, epoxy resin. Naturally the active materials and their concentration in the composition will have to be selected according to the particular surfaces being corrected in order that they are inert at ambient temperatures but will effect positive correction at suitable higher temperatures. The gravure cells that are to be corrected may be formed in known manner for instance by a laser beam or other beam as described in our British Application No. 7931053 or by mechanical means such as described in British Patent Specification No. 1,544,748.

The following are examples of the invention.

EXAMPLE 1

A composition is formulated from 15 parts by weight of a dry mixture of 91% sodium bisulphate, 8.7% sodium fluoride and 0.3% anionic surfactant together with 5 parts silica, 4 parts water and a small amount of a temperature indicating reversible paint, as a temperature indicator. A suitable paint is supplied by Thermographic Measurements Limited. The sodium bisulphate, sodium flouride and anionic surfactant may suitably be provided as a preformed proprietory mix, for instance the product sold under the Trade Name Metex DAS M629 by MacDermid GB Ltd.

EXAMPLE 2

4 parts by weight of a proprietory mix of 91% sodium bisulphate, 8.7% sodium fluoride and 0.3% anionic surfactant are stored separately from 2 parts by weight potassium dichromate crystals. To prepare a paste these two components are separately milled in a ball mill with sufficient water, generally one part by weight, and mixed to make a supersaturated solution in the form of a thick paste. A suitable ball mill is one having aluminum balls and that forms a paste having a maximum particle size of 10 microns.

EXAMPLE 3

Example 2 may be repeated except that the amount of dichromate may be reduced to one part and the amount of the mixture of sodium bisulphate, sodium fluoride and anionic surfactant may be increased to 6 parts.

EXAMPLE 4

A gravure printing roller is formed of a polyacetal copolymer as described in British patent application No. 7931053 and has cells formed in it, in the form of spiral grooves, by a laser engraving process.

The composition of Example 1 is applied by a knife to the cells that are to be subjected to positive correction and then hot air is blown initially onto the area that is to be corrected deepest until the indicator changes colour (at 60° C.) thereby indicating that etching has started. The hot air is then additionally directed onto other filled cells, thereby starting etching in them. When the desired degree of etching has been achieved the surface is washed with water to remove the composition. This process results in a feathering positive correction. If desired the corrected surface could be subjected to electrolysis metal plating, for instance as described in British Patent Specification No. 1,524,717.

EXAMPLE 5

The process of Example 4 is repeated except that the surface is formed of epoxy resin and the composition used is the composition of Example 2. This gives etching in about 1 minute at 90° C. The surface temperature is controlled by a surface probe connected to a thyristor control, that may be connected to a negative feedback circuit.

EXAMPLE 6

The process of Example 5 is repeated except that the surface is of an epoxy resin and the composition is a composition according to Example 3. This gives the desired etching at 90° C. in about 10 minutes.

EXAMPLE 7

The process of Example 5 is repeated but using a polyacetal copolymer surface instead of an epoxy surface. The etching occurs at about 60° C.

We claim:

1. A process of deepening gravure cells of a gravure printing surface by etching with an etching composition the base of the cells to be deepened and thereby effecting positive correction of the gravure printing surface, characterized in that the process comprises depositing into the cells to be deepened a heat activatable etching composition that is a powder, a liquid or a paste and that is substantially inert to the cells at the temperature of deposition, heating the composition to a temperature at which it etches the cells, and, after the desired correction has been effected, terminating the etching by washing and/or cooling the surface, wherein cells which are not to be deepened and which are adjacent to those that are to be deepened are left unprotected during the process of deepening the cells which are to be deepened.

2. A process according to claim 1 characterised in that the etching is terminated by washing the composition from the surface.

3. A process according to claim 1 characterised in that the etchant composition comprises an alkali metal bisulphate.

4. A process according to claim 1 characterized in that the etchant composition also comprises an alkali metal fluoride and an alkali metal bisulphate.

5. A process according to claim 1 characterised in that the etchant composition also comprises inert particulate solid.

6. A process according to claim 1 characterized in that the composition is an aqueous paste comprising, per part by weight water, 2 to 15 parts etchant material and 0 to 3 parts inert particulate material and also comprises a surfactant, and the etchant material is formed of sodium bisulphate and sodium fluoride in a ratio by weight of 5–20:1.

7. A process according to claim 10 characterized in that the etchant material also includes 0.1 to 1 part by weight sodium or potassium dichromate per part by weight sodium bisulphate.

8. A process of deepening gravure cells of a gravure printing surface by etching with an etching composition the base of the cells to be deepened and thereby effecting positive correction of the gravure printing surface, characterized in that the process comprises depositing into the cells to be deepened a heat activatable etching composition which is in the form of an aqueous paste that is substantially inert to the cells at the temperature of deposition, heating the composition to a temperature of from 50 to 95° C. at which temperature the composition etches the cells, and, after the desired correction has been effected, terminating etching by removing the composition by washing with water, wherein cells which are not to be deepened and which are adjacent to those that are to be deepened are left unprotected during the process.

9. A process according to claim 1 or claim 8 characterized in that the composition is applied in the areas of all the cells to be corrected and is heated for different times in different areas, thereby obtaining a feathered correction.

10. A process according to claim 1 or claim 8 characterised in that the etchant composition also comprises an alkali metal dichromate.

11. A process according to claim 1 or claim 8 characterised in that the etchant composition comprises an acid salt.

* * * * *